US008393771B2

(12) United States Patent
Kawamura et al.

(10) Patent No.: US 8,393,771 B2
(45) Date of Patent: Mar. 12, 2013

(54) VEHICLE HEADLAMP

(75) Inventors: Naoshi Kawamura, Shizuoka (JP); Satoru Yashiki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 326 days.

(21) Appl. No.: 12/636,878

(22) Filed: Dec. 14, 2009

(65) Prior Publication Data

US 2010/0149830 A1 Jun. 17, 2010

(30) Foreign Application Priority Data

Dec. 17, 2008 (JP) ..... 2008-320894
Jun. 10, 2009 (JP) ..... 2009-139439

(51) Int. Cl.
*F21S 8/10* (2006.01)

(52) U.S. Cl. ..... 362/548; 362/538; 362/549; 362/507; 362/640; 362/651

(58) Field of Classification Search ..... 362/538, 362/548, 549, 513, 507, 516, 640, 647, 651, 362/652, 655; 439/699.2, 419
See application file for complete search history.

(56) References Cited

U.S. PATENT DOCUMENTS 5,607,228 A * 3/1997 Ozaki et al. ..... 362/263
6,161,951 A * 12/2000 Yoneyama et al. ..... 362/516
6,176,604 B1 * 1/2001 Dubrovin et al. ..... 362/539
6,309,089 B1 * 10/2001 Yoneyama et al. ..... 362/263
6,976,776 B2 * 12/2005 Kakidaira et al. ..... 362/548
7,264,391 B2 * 9/2007 Kaandorp ..... 362/649
7,585,177 B2 * 9/2009 Yashiki et al. ..... 439/226

FOREIGN PATENT DOCUMENTS

| | | | |
|---|---|---|---|
| CN | 1264808 | A | 8/2000 |
| DE | 19815984 | A1 | 10/1999 |
| DE | 10007982 | A1 | 8/2000 |
| DE | 202004009377 | U1 | 9/2004 |
| JP | 2005-302743 | A | 10/2005 |
| JP | 2007-317453 | A | 12/2007 |
| JP | 2008153145 | A | 7/2008 |

OTHER PUBLICATIONS

Chinese Office Action (with translation) dated Jan. 10, 2011 (11 pages).

(Continued)

*Primary Examiner* — Jong-Suk (James) Lee
*Assistant Examiner* — Leah S Macchiarolo
(74) *Attorney, Agent, or Firm* — Sughrue Mion, PLLC

(57) ABSTRACT

A vehicle headlamp including a discharge lamp, which includes a light source, and a cap that holds the light source. The vehicle headlamp also includes a reflector, which includes a light reflecting part and a lamp holding part formed contiguously with one end of the light reflecting part. The vehicle headlamp also includes a socket connected to the cap, which supplies drive current to the lamp. The socket includes a case that holds a structure disposed therein, and a connection portion, which is connected to the cap and which protrudes toward the cap from an opposite surface of the case facing the cap. A conductive member is mounted on the lamp holding part to transmit noise generated when the lamp is turned on and a conducting portion is formed on the opposite surface of the case to surround the connection portion. The conductive member and the conducting portion are connected.

8 Claims, 16 Drawing Sheets

OTHER PUBLICATIONS

Korean Office Action dated Aug. 26, 2011 from the Korean Patent Office in corresponding Korean Patent Application No. 10-2009-0123458.

Search Report issued May 4, 2012 by the European Patent Office in counterpart European Application No. 09178008.0.

* cited by examiner

VEHICLE HEADLAMP

This application claims priority from Japanese Patent Applications No. 2008-320894, filed on Dec. 17, 2008, and No. 2009-139439, filed on Jun. 10, 2009, the entire contents of which are incorporated by reference herein.

BACKGROUND

1. Technical Field

The present disclosure relates to a vehicle headlamp. More particularly, the present disclosure relates to a vehicle headlamp that can secure good conductivity between a reflector and a socket and can reduce the size of a vehicle headlamp by forming a conducting portion, which is connected to a conductive member to transmit noise generated when the discharge lamp is turned on, on a certain surface of a case of the socket.

2. Related Art

For example, there is a vehicle headlamp where a lamp unit, which includes a light source and a reflector reflecting light emitted from the light source, is disposed in a lamp outer case, which includes a cover and a lamp housing.

There are vehicle headlamps where a discharge lamp is used as the light source and a lighting device supplies drive current to the discharge lamp in order to turn on the discharge lamp (see e.g., JP-A-2007-317453 and JP-A-2005-302743).

The lighting device may include an electric power supply, a control unit, a high-voltage generator, and the like. The electric power supply may include a lighting circuit unit, for example, a switching element, and supplies electric power to the discharge lamp. The control unit controls the electric power supplied to the discharge lamp. The high-voltage generator includes a starting circuit referred to as a starter that turns on the discharge lamp by generating a high voltage in the discharge lamp.

In the vehicle headlamp described in JP-A-2007-317453, the lighting device includes: a socket that includes a case for holding a predetermined structure and a connection portion connected to a cap of the discharge lamp; a device body that is disposed at a lower end portion of a lamp outer case; and a connecting cable that is connected to the device body and the socket. The electric power supply, the control unit, the high-voltage generator, and the like are disposed in the device body.

In the vehicle headlamp described in JP-A-2005-302743, the lighting device includes: a socket that is connected to a cap of the discharge lamp; a device body that is disposed at a lower end portion of a lamp outer case; and a connecting cable that connects the socket to the device body. The electric power supply and the control unit are disposed in the device body, and the high-voltage generator is disposed in the socket.

In the vehicle headlamp using a discharge lamp as the light source, there is a concern that noise is generated when the discharge lamp is turned on, which has a negative influence on devices in the vehicle, for example, a communication device such as a radio. For this reason, the noise needs to be transmitted along a predetermined path and be grounded.

Accordingly, in the above-mentioned vehicle headlamps, a conductive member, such as a leaf spring member, is mounted at the rear end portion of the reflector having conductivity, an outer peripheral surface of the case forms the socket so as to have conductivity, and the conductive member and the outer peripheral surface of the case are connected to each other and grounded, while the connection portion of the socket is connected to a cap of the discharge lamp, thereby preventing an bad influence caused by the generation of noise.

Meanwhile, in the structure where the conductive member and the outer peripheral surface of the case of the socket are connected to each other for grounding as described above, the conductive member is positioned at the periphery of the case. Accordingly, the vehicle headlamp increases in size toward the periphery of the case, and thus size reduction of the vehicle headlamp is hindered.

In the vehicle headlamp described in JP-A-2005-302743, the high-voltage generator is disposed in the socket, and thus the socket in particular increases in size toward the periphery of the case. For this reason, it is difficult to reduce the size of the vehicle headlamp.

SUMMARY

It is an illustrative aspect of the present invention to provide a vehicle headlamp which can secure good conductivity between a reflector and a socket, and reduce the size of the vehicle headlamp.

In order to achieve this object, an exemplary embodiment of the present invention includes a vehicle headlamp comprising a discharge lamp, comprising a light source that emits light, and a cap that holds the light source; a reflector comprising a light reflecting part that reflects the light emitted from the light source, and a lamp holding part, which is formed contiguously with one end of the light reflecting part and which holds the cap; and a socket, which is connected to the cap and which supplies drive current to the discharge lamp, the socket comprising a case that holds a specific structure disposed therein, and a connection portion, which is connected to the cap, and which protrudes toward the cap from an opposite surface of the case facing the cap. The conductive member is mounted on the lamp holding part to transmit noise generated when the discharge lamp is turned on, and a conducting portion is formed on the opposite surface of the case to surround the connection portion. Further, the conductive member and the conducting portion are connected to each other in a connection direction along which the cap and the connection portion are also connected to each other.

According to aspects of the present invention, since the conductive member is not disposed at the periphery of the socket, the vehicle headlamp does not increase in size toward the periphery of the socket and may secure good conductivity between the reflector and the socket and reduce the size of the vehicle headlamp.

DETAILED DESCRIPTION OF EXEMPLARY EMBODIMENTS

A vehicle headlamp according to exemplary embodiments of the invention will now be described with reference to accompanying drawings.

Vehicle headlamps 1 are mounted and disposed on left and right ends of a front end of a vehicle body, respectively.

Figure 1:
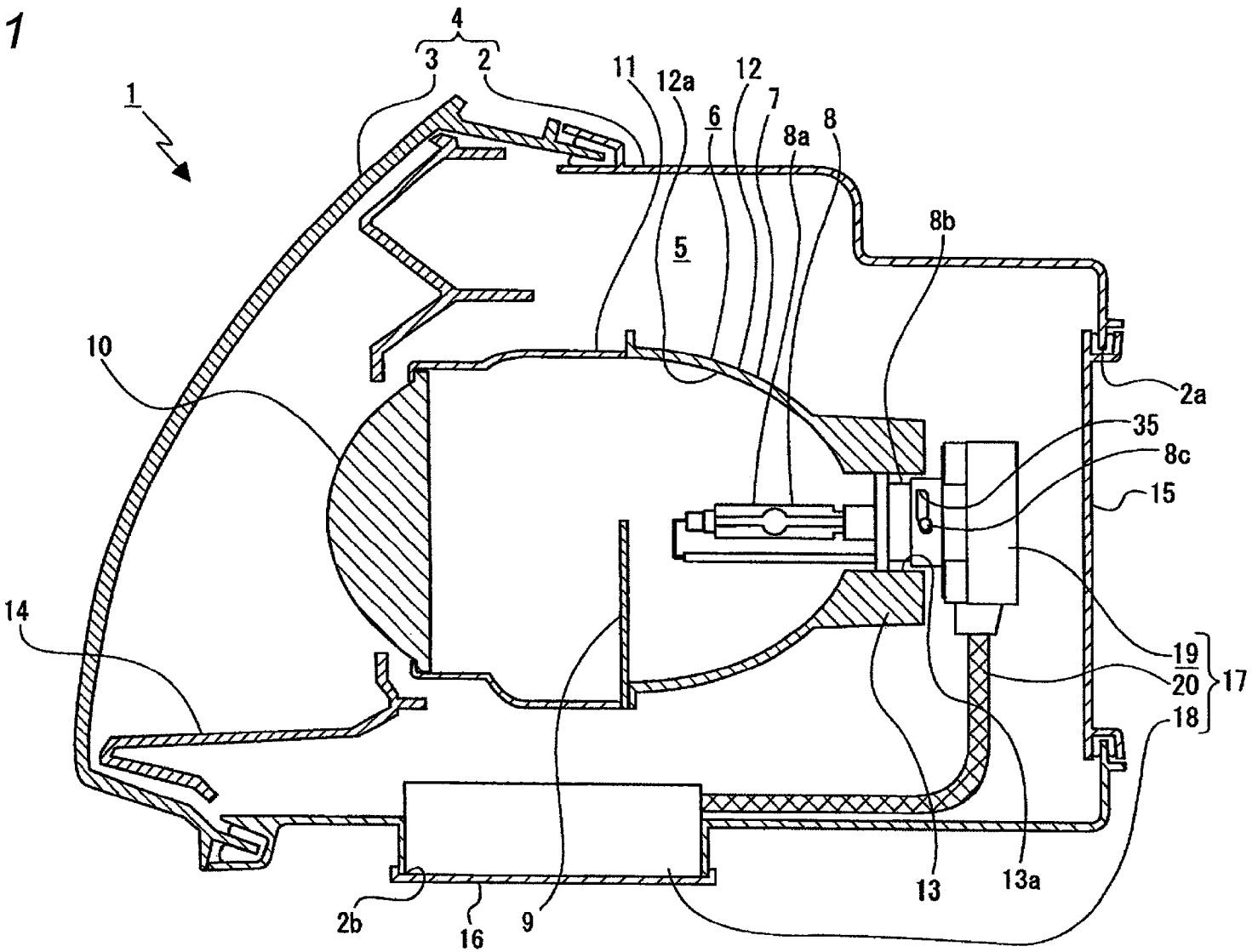
FIG. 1 is a schematic longitudinal sectional view of a vehicle headlamp according to an exemplary embodiment of the present invention.

As shown in FIG. 1, a vehicle headlamp includes: a lamp housing 2 that includes an opened recess at the front portion thereof; and a front cover 3 that covers the front opening of the lamp housing 2. The lamp housing 2 and the front cover 3 form a lamp outer case 4, and the inside of the lamp outer case 4 is formed as a lamp chamber 5.

A mounting opening 2*a*, which penetrates in a front-and-rear direction, is formed at the rear end portion of the lamp housing 2. A disposition opening 2*b*, which penetrates in an up-and-down direction, is formed at the lower end portion of the lamp housing 2.

A lamp unit 6 is disposed in the lamp chamber 5. The lamp unit 6 is supported by a supporting mechanism (not shown) so as to be tilted with respect to the lamp housing 2 in a left-and-right direction and an up-and-down direction.

The lamp unit 6 is disposed in the lamp chamber 5 so as to be tilted. The lamp unit has a so-called swivel function, which changes the direction of an optical axis of the lamp unit by tilting the lamp unit in a horizontal direction so that the lamp unit follows the traveling direction of a vehicle.

The lamp unit 6 includes: a reflector 7 that reflects light; a discharge lamp 8 that is mounted and held at the rear end portion of the reflector 7; a shade 9 that is mounted at the front end portion of the reflector 7; a lens 10 that is disposed on the front side of the discharge lamp 8; and a lens holder 11 that holds the lens 10 and mounts the lens 10 on the reflector 7.

The reflector 7 has conductivity, and includes a light reflecting part 12 and a lamp holding part 13 that continues toward the rear end of the light reflecting part 12. The light reflecting part 12 is formed in the shape of a bowl that is opened at the front portion thereof, and the inner surface of the reflecting part is formed as a reflecting surface 12*a*. The reflecting surface 12*a* is formed of, for example, a paraboloid. The lamp holding part 13 protrudes rearward from the rear end of the light reflecting part 12. A holding hole 13*a*, which penetrates in the front-and-rear direction, is formed at the lamp holding part 13.

The discharge lamp 8 includes a light source 8*a* that is formed by enclosing a light-emitting part (light-emitting tube) in a glass tube, and a cap 8*b* that is held at the lamp holding part 13 of the reflector 7. The discharge lamp 8 is held by the lamp holding part 13 when the cap 8*b* is inserted into the holding hole 13*a*. Mounting pins 8*c* protrude outward from the outer peripheral surface of the cap 8*b*.

The shade 9 is mounted at the front end portion of the reflector 7, and has a function to block a part of the light reflected from the discharge lamp 8.

An extension 14, which covers a part of the lamp unit 6, is disposed in the lamp chamber 5.

A back cover 15, which covers the mounting opening 2*a*, is mounted at the rear end portion of the lamp housing 2.

A cover body 16, which covers the disposition opening 2*b*, is mounted at the lower end portion of the lamp housing 2. The cover body 16 is formed in the shape of a shallow box that is opened at the upper portion thereof.

A lighting device 17, which turns on the discharge lamp 8, is disposed in the lamp chamber 5. The lighting device 17 includes a device body 18, a socket 19, and a connecting cable 20. Upper and lower ends of the connecting cable 20 are connected to the socket 19 and the device body 18, respectively.

The device body 18 of the lighting device 17 is disposed on the cover body 16, and the socket 19 is connected to the cap 8*b* of the discharge lamp 8.

Figure 2:
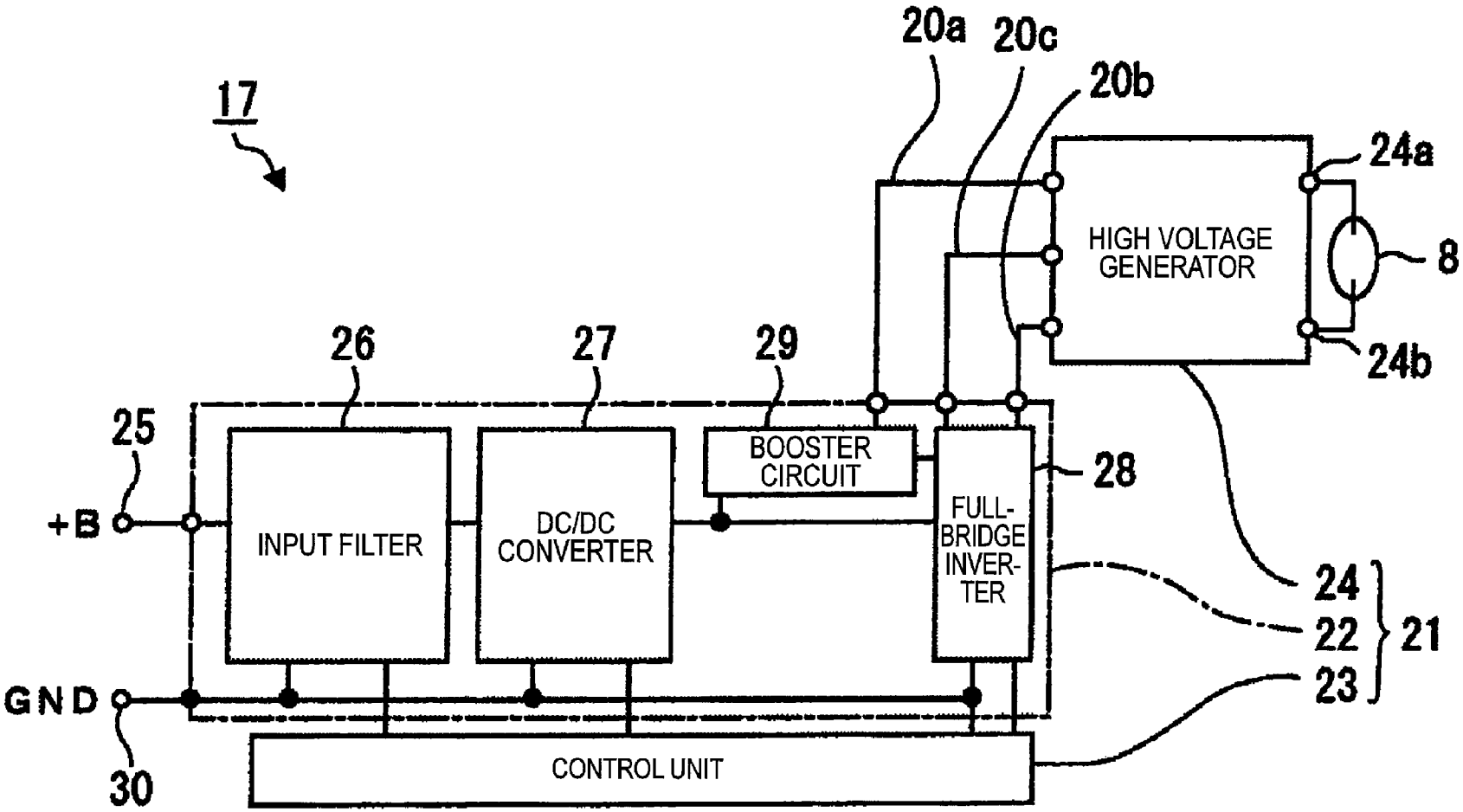
FIG. 2 is a block diagram showing the circuit configuration of a lighting device.

As shown in FIG. 2, the lighting device 17 includes a lighting circuit unit 21. The lighting circuit unit 21 includes an electric power supply 22, a control unit 23, and a high-voltage generator 24. The electric power supply 22 supplies electric power, which is voltage-converted by switching a DC input voltage using a switching element, to the discharge lamp 8. The control unit 23 controls the electric power that is supplied from the electric power supply 22 to the discharge lamp 8. The high-voltage generator 24 includes a starting circuit referred to as a starter that turns on the discharge lamp 8 by generating a high voltage in the discharge lamp 8.

The electric power supply 22 and the control unit 23 of the lighting circuit unit 21 are provided in the device body 18, and the high-voltage generator 24 thereof is provided in the socket 19.

The electric power supply 22 includes an input filter 26 that is connected to a DC power source 25; a DC/DC converter 27 that converts a DC input voltage supplied from the DC power source 25 into a desired DC voltage; a full-bridge inverter 28 serving as a DC-AC conversion circuit; and a booster circuit 29 that boosts a voltage and supplies the voltage to the high-voltage generator 24. The electric power supply 22 is connected to the DC power source 25 and a ground circuit (GND) 30.

The input filter 26 has a function to suppress the noise generated in the lighting circuit unit 19 and the noise entering the lighting circuit unit 19.

The DC/DC converter 27 functions as a DC-DC conversion circuit, and converts the DC input current supplied from the DC power source 25 into a desired DC voltage through the input filter 26. A switching element in the DC/DC converter 27 is driven on the basis of a control signal received from the control unit 23.

The full-bridge inverter 28 functions as a DC-AC conversion circuit, and converts the output voltage of the DC/DC converter 27 into an AC voltage (rectangular wave) and supplies the AC voltage to the discharge lamp 8.

The booster circuit 29 boosts the DC voltage converted by the DC/DC converter 27, and supplies the DC voltage to the high-voltage generator 24.

The control unit 23 has a function to perform the lighting control (excessive/normal electric power control) of the discharge lamp 8. The control unit 23 is also provided with a fail-safe circuit that performs the detection of abnormal input/output and the operation stop control.

The connecting cable 20, which connects the device body 18 to the socket 19, includes three connecting wires 20*a*, 20*b*, and 20*c*. The connecting wire 20*c* functions as a ground connecting wire.

The high-voltage generator 24 is connected to the discharge lamp 8 through a high-voltage terminal 24*a* and a low-voltage terminal 24*b*. The high-voltage generator 24 generates a high-voltage pulse of, for example, about 25 kV and starts the turning-on of the discharge lamp 8.

Figure 3:
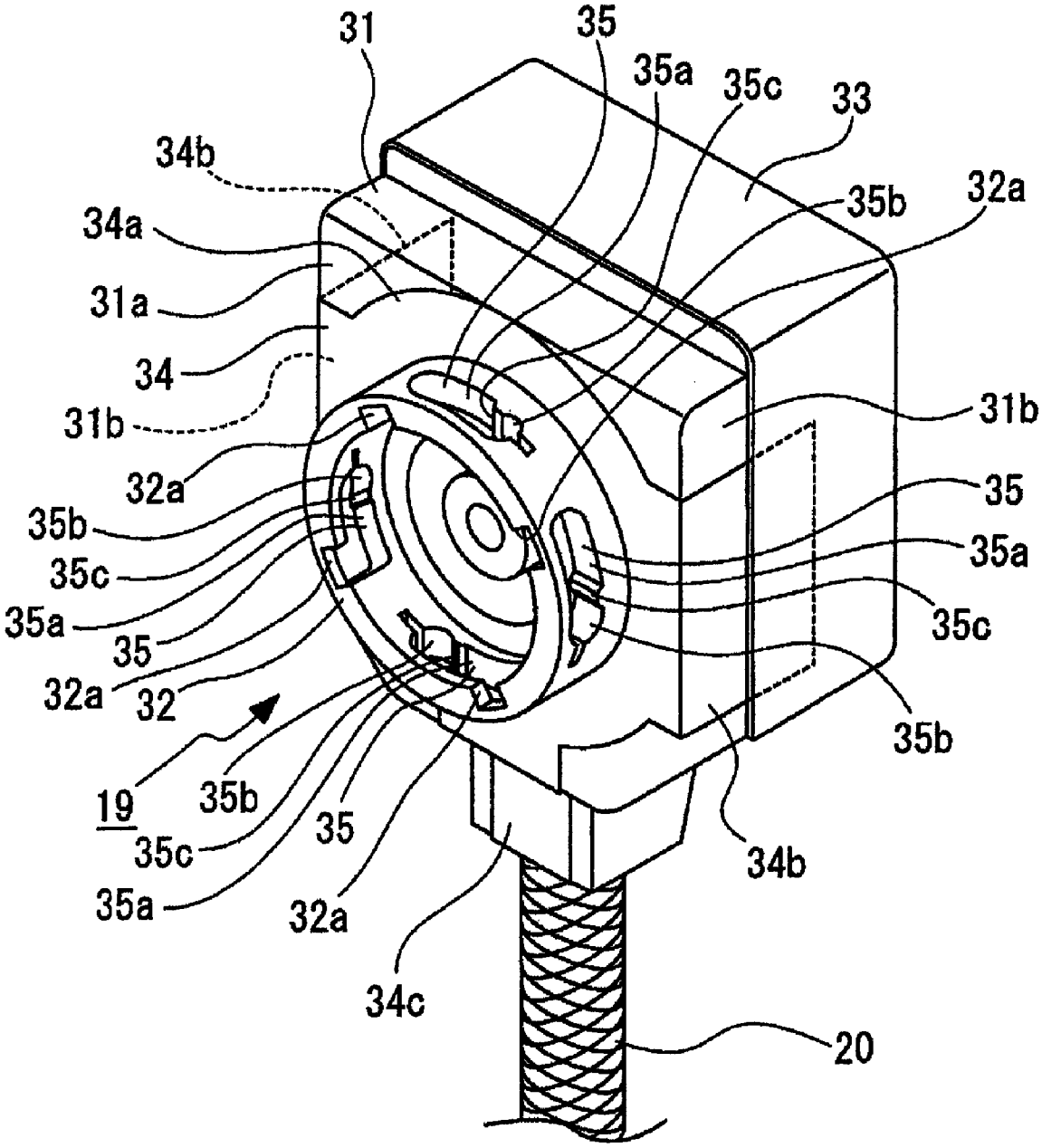
FIG. 3 is an enlarged perspective view of a socket.

As shown in FIG. 3, the socket 19 of the lighting device 17 includes a case 31 and a connection portion 32. The high-voltage generator 24 and the like are disposed in the case 31. Except for the outer peripheral portion of the front surface of the case 31, the connection portion 32 protrudes forward from a portion of the front surface 31*a* of the case 31, and is formed in a substantially cylindrical shape.

The case 31 is formed in a substantially rectangular parallelepiped shape, and a portion of the case 31, excluding the front end portion of the case 31, is covered with a conductive metal cover 33. The lower end portion of the metal cover 33 is connected to the ground connecting wire 20*c* of the connecting cable 20.

A conductive plate 34, which is made of a conductive metallic material, is mounted at the front end portion of the case 31.

The conductive plate 34 includes: a conducting portion 34*a* that is formed in a substantially annular shape, connection portions 34*b* that respectively protrude rearward from the left and right ends of the conducting portion 34*a*, and a connection protrusion 34*c* that protrudes downward from the lower end portion of the conducting portion 34*a*. The conducting portion 34*a* is mounted on the front surface 31*a* of the case 31 outside the connection portion 32. The connection portions 34*b* are mounted on the left and right side surfaces 31*b* of the case 31, respectively. The rear end portions of the connection portions are connected to the metal cover 33. The lower end portion of the connection protrusion 34*c* is connected to the ground connecting wire 20*c* of the connecting cable 20.

Mounting holes 35 are formed at the connection portion 32 to be spaced from each other in a circumferential direction. The mounting hole 35 includes a linear portion 35*a* that extends in the circumferential direction of the connection portion 32 and a locking portion 35*b* that continues to one end of the linear portion 35*a*. The locking portion 35*b* is inclined so as to be displaced rearward as being distant from the linear portion 35*a*. A stopper protrusion 35*c*, which slightly protrudes forward, is formed on the edge of the opening of the mounting hole 35 at a connection portion between the linear portion 35*a* and the locking portion 35*b*.

Insertion grooves 32*a*, which extend in the front-and-rear direction, are formed at the connection portion 32 so as to be spaced from each other in a circumferential direction. The insertion groove 32*a* is opened to the front surface of the connection portion 32, and the rear end of the insertion groove 32*a* continues to the end of the linear portion 35*a* of the mounting hole 35 opposite to the locking portion 35*b*.

Figure 4:
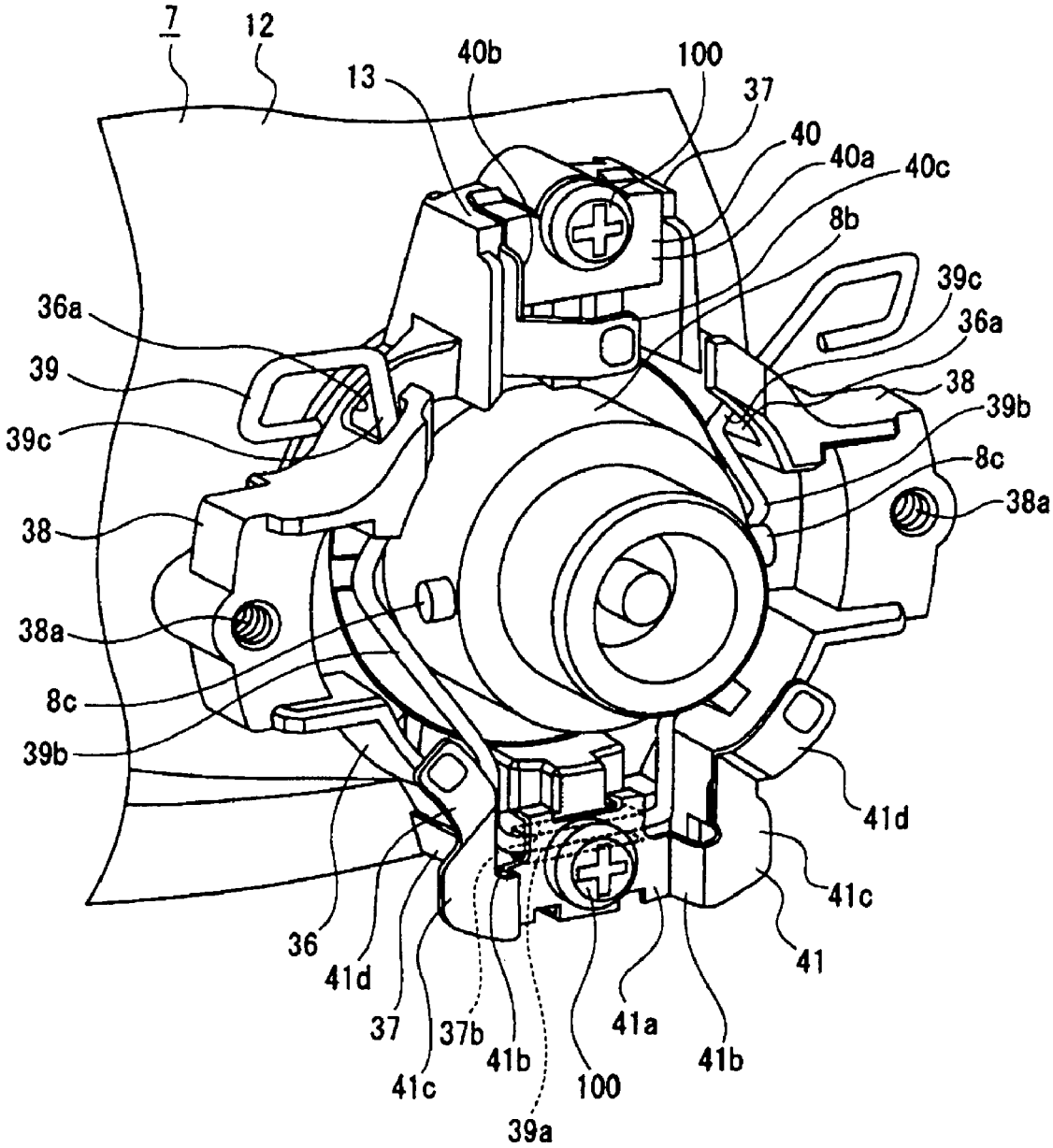
FIG. 4 is an enlarged perspective view showing a discharge lamp and a conductive member mounted on a lamp holding part.

As shown in FIG. 4, the lamp holding part 13 of the reflector 7 includes a base portion 36 that is formed in a substantially cylindrical shape, and mounting protrusions 37, 38 that protrude outward from the outer peripheral surface of the base portion 36. The mounting protrusions 37, 38 are formed so as to be spaced from each other in the circumferential direction. The mounting protrusions 37 are spaced from each other in the up-and-down direction, and the mounting protrusions 38 are spaced from each other in the left-and-right direction. Threaded holes 37*a*, 38*a*, which are opened to the rear side, are formed at the mounting protrusions 37, 38, respectively (see FIGS. 4 and 5).

Locking grooves 36*a* are formed at the base portion 36 between the upper mounting protrusion 37 and the mounting protrusions 38 (see FIG. 4).

A supporting groove 37*b*, which extends in the left-and-right direction, is formed at the lower mounting protrusion 37.

A fixing member 39 is rotatably supported by the supporting groove 37*b* of the mounting protrusion 37. The fixing member 39 is formed as a wire spring obtained by bending a linear metallic material in a predetermined shape. The fixing member 39 includes a supported portion 39*a* that extends in the left-and-right direction, pressing portions 39*b* that are bent from the left and right ends of the supported portion 39*a*, respectively, and locking portions 39*c* that continue to the pressing portions 39*b*, respectively.

The supported portion 39*a* of the fixing member 39 is rotatably supported by the supporting groove 37*b*, and the locking portions 39*c* thereof are locked in the locking grooves 36*a*, respectively. When the locking portions 39*c* of the fixing member 39 are locked in the locking grooves 36*a*, respectively, the pressing portions 39*b* press and come into contact with a part of the cap 8*b* of the discharge lamp 8 from the rear side direction. The cap 8*b* of the discharge lamp 8 is pressed toward the front side by the pressing portions 39*b*, so that the outer peripheral portion of the front surface of the cap 8*b* is pressed against a part of the lamp holding part 13 and is held by the lamp holding part 13.

A conductive member 40 that is elastically deformable is mounted on the upper mounting protrusion 37. The conductive member 40 is a leaf spring member. The conductive member 40 includes a mounted surface portion 40*a* that faces the front-and-rear direction, a connection-surface portion 40*b* that protrudes rearward from one side edge of the mounted surface portion 40*a*, and a connection piece 40*c* that is bent from the rear edge of the connection-surface portion 40*b* and substantially faces the front-and-rear direction. The mounted surface portion 40*a* of the conductive member 40 is mounted on the mounting protrusion 37 by a mounting screw 100 inserted into the threaded hole 37*a*.

An elastically deformable conductive member 41 is mounted on the lower mounting protrusion 37. The conductive member 41 is a leaf spring member. The conductive member includes a mounted surface portion 41*a* that faces the front-and-rear direction, first connection-surface portions 41*b* that respectively protrude rearward from the left and right side edges of the mounted surface portion 41*a*, second connection-surface portions 41*c* that are respectively bent outward from the rear edges of the connection-surface portions 41*b*, and connection pieces 41*d* that respectively continue to the second connection-surface portions 41*c* and substantially face the front-and-rear direction.

When the supported portion 39*a* of the fixing member 39 is supported by the supporting groove 37*b*, the mounted surface portion 41*a* of the conductive member 41 is mounted on the mounting protrusion 37 by the mounting screw 100 tightened to the threaded hole 37*a*, while covering the supported portion 39*a* from the rear side. Accordingly, since the supported portion 39*a* of the fixing member 39 and the mounted surface portion 41*a* of the conductive member 41 are mounted on the lamp holding part 13 by one mounting screw 100, it may be possible to reduce the number of parts and easily perform the mounting of parts.

The connection portion 32 is mounted on the cap 8*b* of the discharge lamp 8 as described below, so that the socket 19 is connected to the discharge lamp 8 (see FIGS. 5 to 7).

Figure 5:
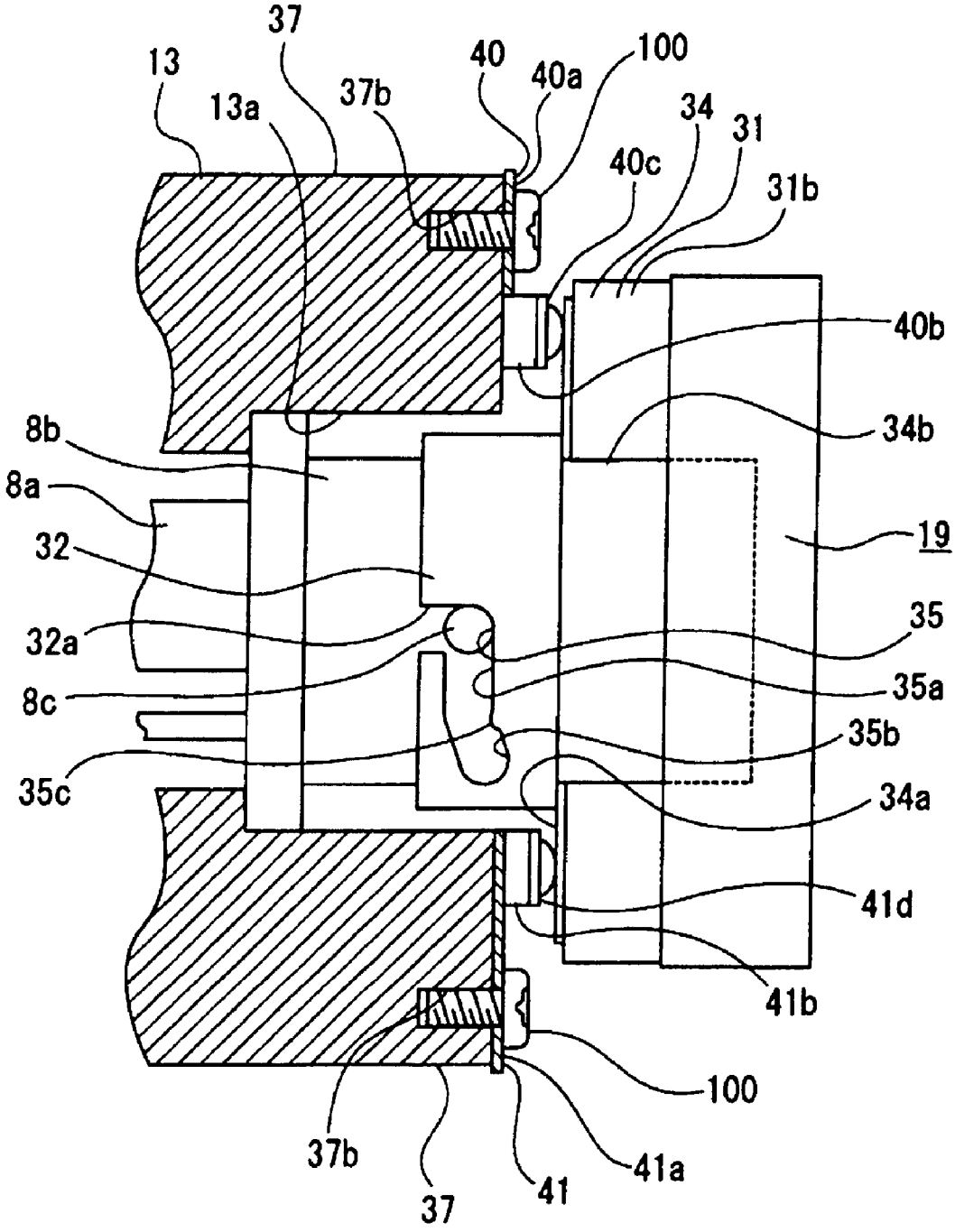
FIG. 5 is a partially cross sectional side view showing that a mounting pin of a discharge lamp is inserted into an insertion groove of the socket.

Firstly, the mounting pins 8*c* formed at the cap 8*b* of the discharge lamp 8 are inserted into corresponding insertion grooves 32*a* that are formed at the connection portion 32 of the socket 19, respectively (see FIG. 5). When the mounting pins 8*c* are inserted into the insertion grooves 32*a*, the conducting portion 34*a* of the conductive plate 34 mounted at the socket 19 comes into contact with the connection pieces 40*c*, 41*d* of the conductive members 40 and 41. In this case, the connection pieces 40*c*, 41*d* of the conductive members 40 and 41 are elastically deformed and pressed against the conducting portion 34*a*.

Figure 6:
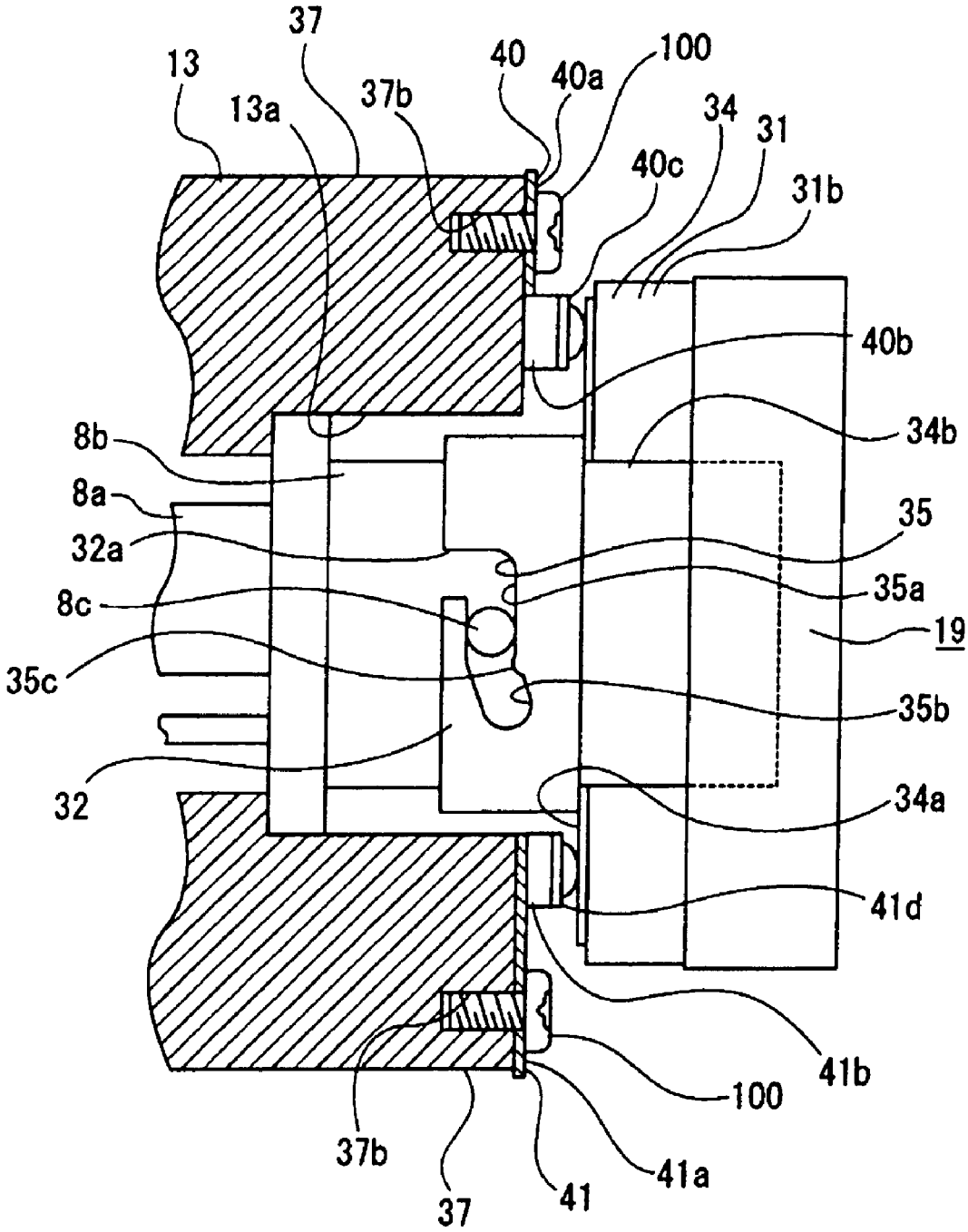
FIG. 6 is a partial cross sectional side view showing that the mounting pin of the discharge lamp is inserted into a linear portion of a mounting hole of the socket.

After that, the socket 19 is rotated with respect to the discharge lamp 8, and the mounting pins 8*c* are inserted into the linear portions 35*a* of the mounting holes 35 formed at the connection portion 32, respectively (see FIG. 6). When the mounting pins 8*c* are inserted into the linear portions 35*a*, respectively, the conducting portion 34*a* slides on the connection pieces 40*c*, 41*d*.

Figure 7:
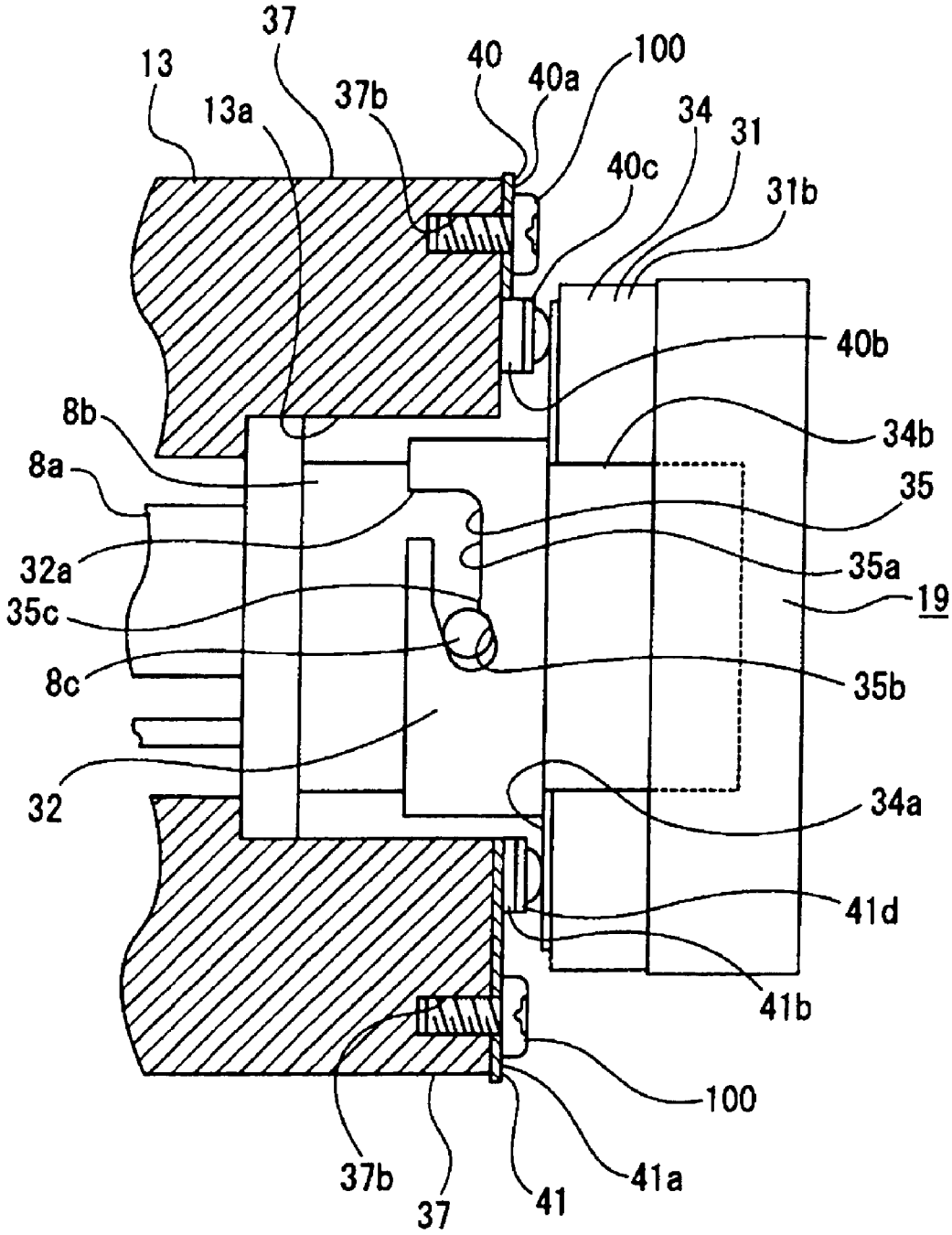
FIG. 7 is a partial cross sectional side view showing that the mounting pin of the discharge lamp is inserted into a locking portion of the mounting hole of the socket.

The socket 19 is further rotated with respect to the discharge lamp 8 in the same direction, so that the mounting pins 8*c* are inserted into and engaged with the corresponding locking portions 35*b* of the mounting holes 35, respectively (see FIG. 7). The locking portions 35*b* are inclined so as to be displaced rearward further from the linear portions 35*a*, respectively. Accordingly, when the mounting pins 8*c* are inserted into the locking portions 35*b*, respectively, the socket 19 is moved forward with respect to the discharge lamp 8. Therefore, the connection pieces 40*c*, 41*d* of the conductive members 40 and 41 are further elastically deformed, so that the connection pieces 40*c*, 41*d* are pressed against the conducting portion 34*a* by a strong force.

As described above, the socket 19 is moved forward with respect to the discharge lamp 8 when the socket 19 is mounted on the discharge lamp 8. Accordingly, the connection pieces 40*c*, 41*d* are pressed against the conducting portion 34*a* by a strong force, so that it may be possible to reliably connect the conductive members 40 and 41 to the conducting portion 34*a*.

Further, since the conductive members 40 and 41 include the elastically deformable connection pieces 40*c*, 41*d*, it may be possible to secure good connectivity between the conductive members 40 and 41 and the conducting portion 34*a*.

Meanwhile, since the conductive member 41 includes two connection pieces 41*d*, it may be possible to increase the contact area between the conductive member 41 and the conducting portion 34*a* of the conductive plate 34 without increasing the number of parts, by using the conductive member 41 as a member that is to be connected to the conducting portion 34*a* of the conductive plate 34.

When the mounting pins 8*c* are engaged with the locking portions 35*b* of the mounting holes 35, respectively, as described above, the stopper protrusions 35*c* are engaged with the mounting pins 8*c*, so that the movement of the mounting pins 8*c* toward the linear portions 35*a* is restricted. Accordingly, the separation of the socket 19 from the discharge lamp 8 is prevented.

When the discharge lamp 8 is turned on, there is a concern that noise is generated and has a negative influence on a communication device such as a radio. However, the noise is transmitted from the reflector 7 to the conductive plate 34 through the conductive members 40 and 41, and is transmitted from the conductive plate 34 through the ground connecting wire 20*c* of the connecting cable 20 or through the metal cover 33, and to the ground circuit 30. Accordingly, it may be possible to avoid the noise which causes a bad influence the communication device.

A modification of the conductive member will be described below (see FIGS. 8 to 16).

Figure 8:
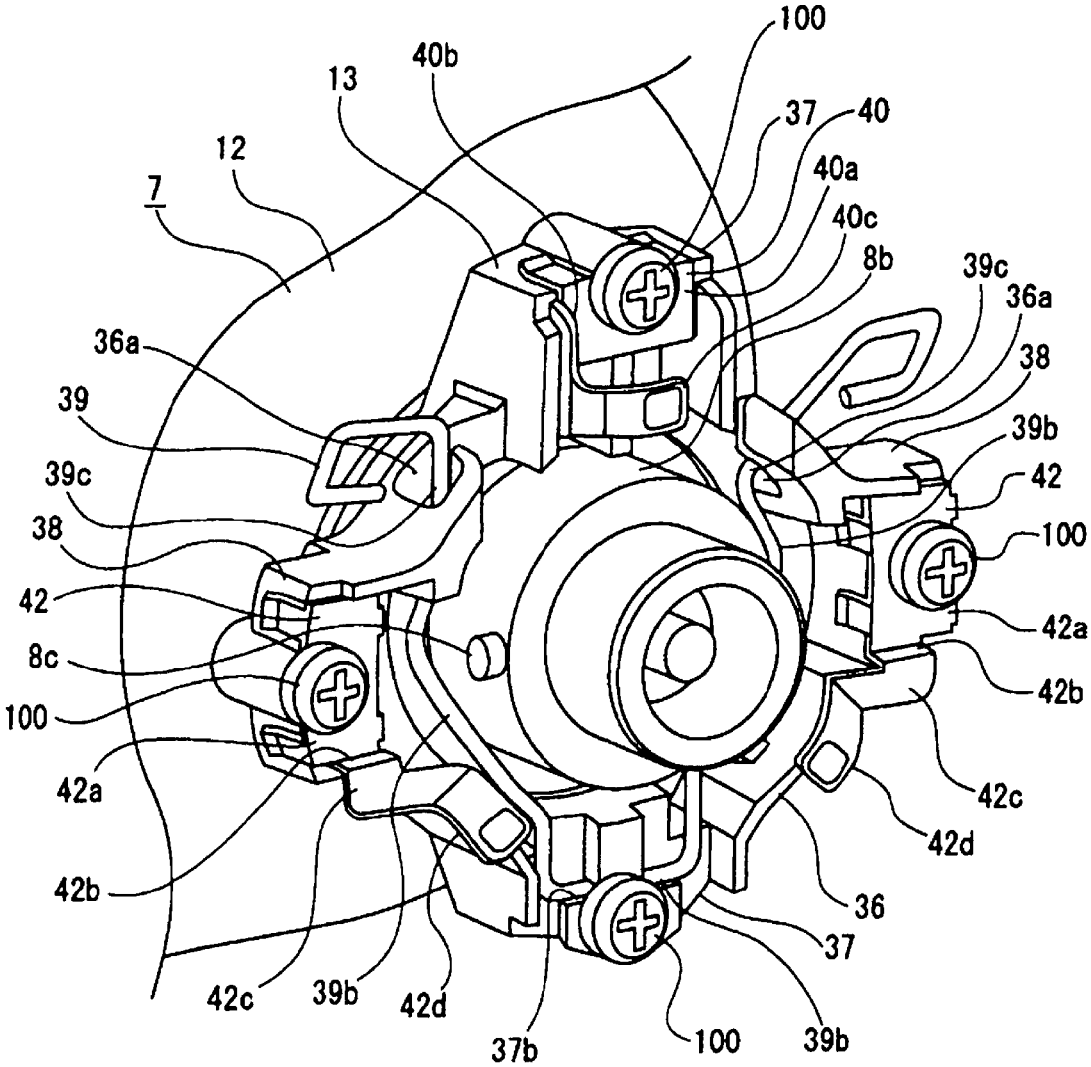
FIG. 8 is an enlarged perspective view showing that a conductive member according to a first modification of the present invention is mounted on the lamp holding part of a reflector.

Conductive members 42 according to a first modification are mounted on the mounting protrusions 38 that are positioned at the left and right portions of the lamp holding part 13 of the reflector 7 (see FIG. 8). Meanwhile, in FIG. 8, not only the conductive members 42, but also the conductive member 40 mounted on the mounting protrusion 37, is used as a leaf spring member to be connected to the conductive plate 34 of the socket 19.

The conductive members 42 include mounted surface portions 42*a* that face the front-and-rear direction, first connection-surface portions 42*b* that respectively protrude rearward from the lower edges of the mounted surface portions 42*a*, second connection-surface portions 42*c*, that protrude from the rear edges of the connection-surface portions 42*b* so as to approach each other, and connection pieces 42*d* that respectively continue to the second connection-surface portions 42*c* and substantially face the front-and-rear direction.

The connection piece 40*c* of the conductive member 40 and the connection pieces 42*d* of the conductive member 42 are connected to the conducting portion 34*a* of the conductive plate 34 of the socket 19.

The mounted surface portions 42*a* of the conductive members 42 are mounted on the mounting protrusions 38 by mounting screws 100 that are tightened to the threaded holes 38*a*, respectively.

It may also be possible to secure a good connection state between the reflector 7 and the conducting portion 34*a* of the conductive plate 34 of the socket 19, even by using the mounting protrusions 38 that are positioned at the left and right portions of the lamp holding part 13 of the reflector 7.

Figure 9:
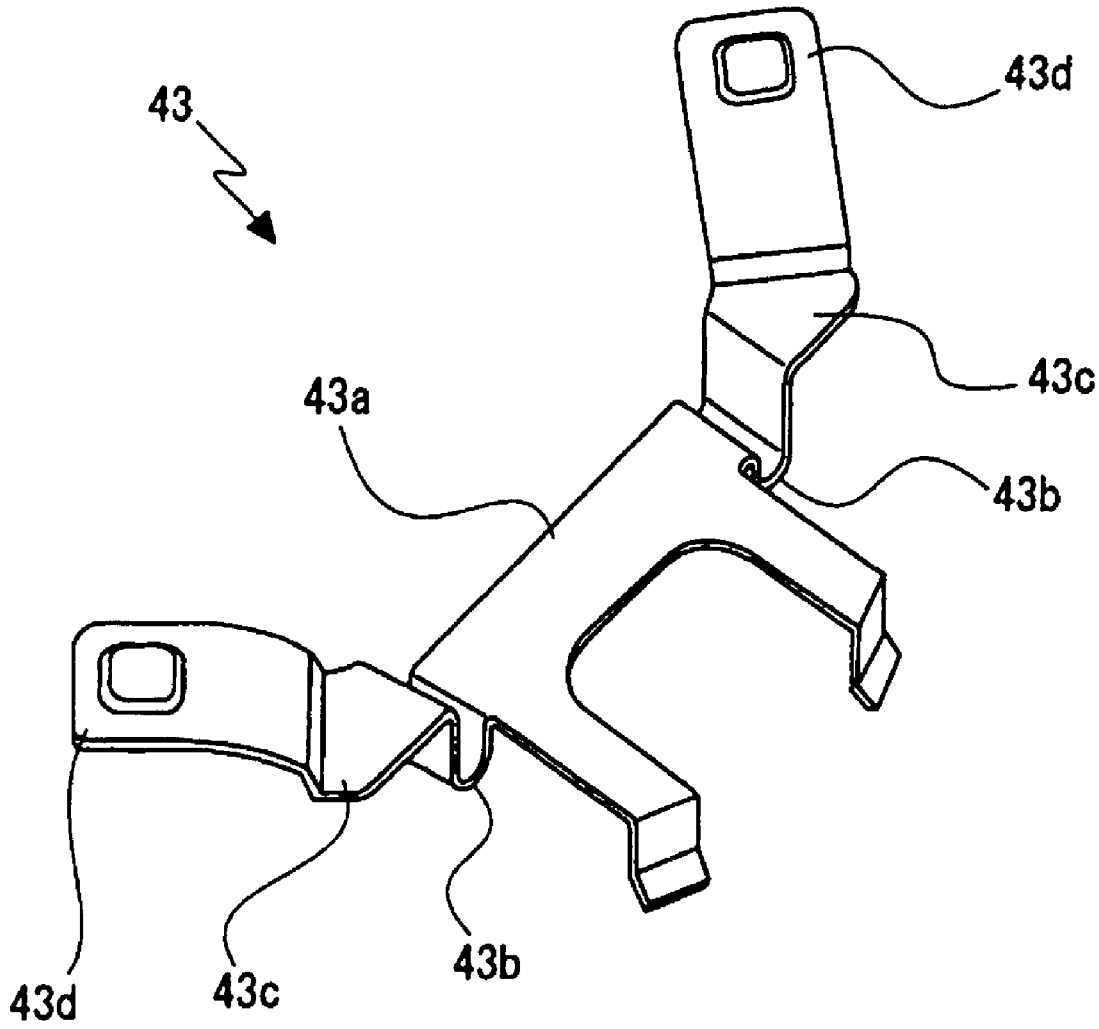
FIG. 9 is an enlarged perspective view of a conductive member according to a second modification of the present invention.
Figure 10:
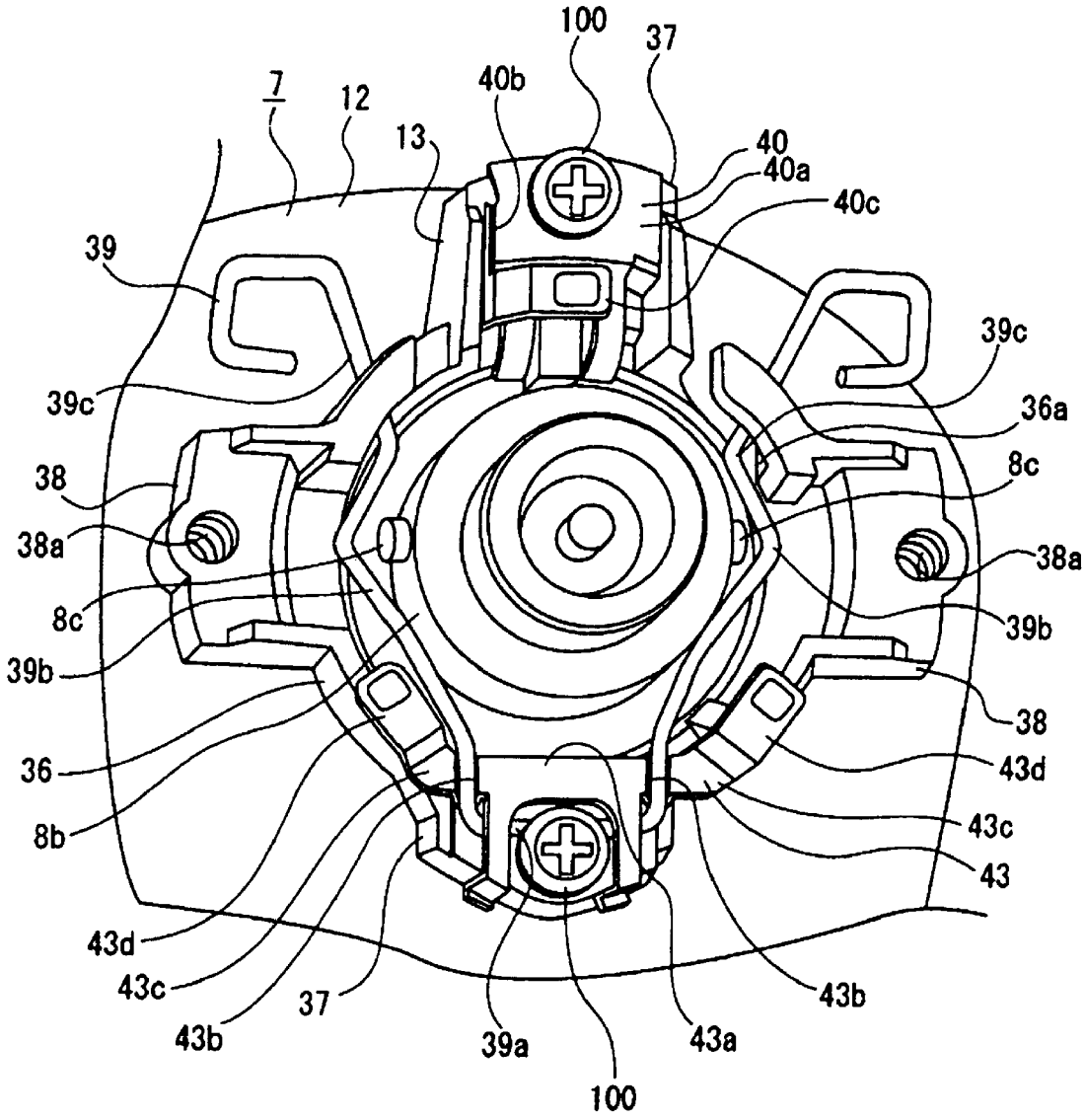
FIG. 10 is an enlarged perspective view showing the conductive member according to the second modification mounted on the lamp holding part of the reflector.

A conductive member 43 according to a second modification is mounted on the lower mounting protrusion 37 of the lamp holding part 13 of the reflector 7 (see FIGS. 9 and 10). Meanwhile, in FIG. 10, not only the conductive member 43, but also the conductive member 40 mounted on the mounting protrusion 37 is used as a leaf spring member that is to be connected to the conductive plate 34 of the socket 19.

The conductive member 43 includes a mounted surface portion 43*a* that faces the front-and-rear direction, insertion grooves 43*b* that are formed at the left and right side edges of the mounted surface portion 43*a*, connection-surface portions 43*c* that continue to the respective outer ends of the insertion grooves 43*b*, and connection pieces 43*d* that respectively continue to the connection-surface portions 43*c* and substantially face front-and-rear direction.

The connection piece 40*c* of the conductive member 40 and the connection pieces 43*d* of the conductive member 43 are connected to the conducting portion 34*a* of the conductive plate 34 of the socket 19.

Before the supported portion 39*a* of the fixing member 39 is supported by the supporting groove 37*b* and the locking portions 39*c* are locked to the locking grooves 36*a*, the mounted surface portion 43*a* of the conductive member 43 is mounted on the mounting protrusion 38 while covering the supported portion 39*a* from the rear side. When the mounted surface portion 43*a* is placed on the mounting protrusion 38, the fixing member 39 is rotated about the supported portion 39*a*, so that the locking portions 39*c* are locked to the locking grooves 36*a*, respectively. In this case, the end portions of the pressing portions 39*b* of the fixing member 39 that are located close to the supported portion 39*a* are inserted into the insertion grooves 43*b* of the conductive member 43 from the rear side, respectively. Accordingly, the insertion grooves 43*b* are pressed from the rear side by the pressing portions 39*b* of the fixing member 39, so that the conductive member 43 is mounted on the mounting protrusion 37.

Since the conductive member 43 is mounted on the mounting protrusion 37 by being pressed by the fixing member 39 as described above, the conductive member 43 is mounted on the mounting protrusion 37 without using the mounting screw 100. Accordingly, it may be possible to reduce the number of parts.

Meanwhile, since the conductive member 43 includes two connection pieces 43*d*, it may be possible to increase the contact area between the conductive member 43 and the conducting portion 34*a* of the conductive plate 34 without increasing the number of parts like in the case of the conductive member 41.

Figure 11:
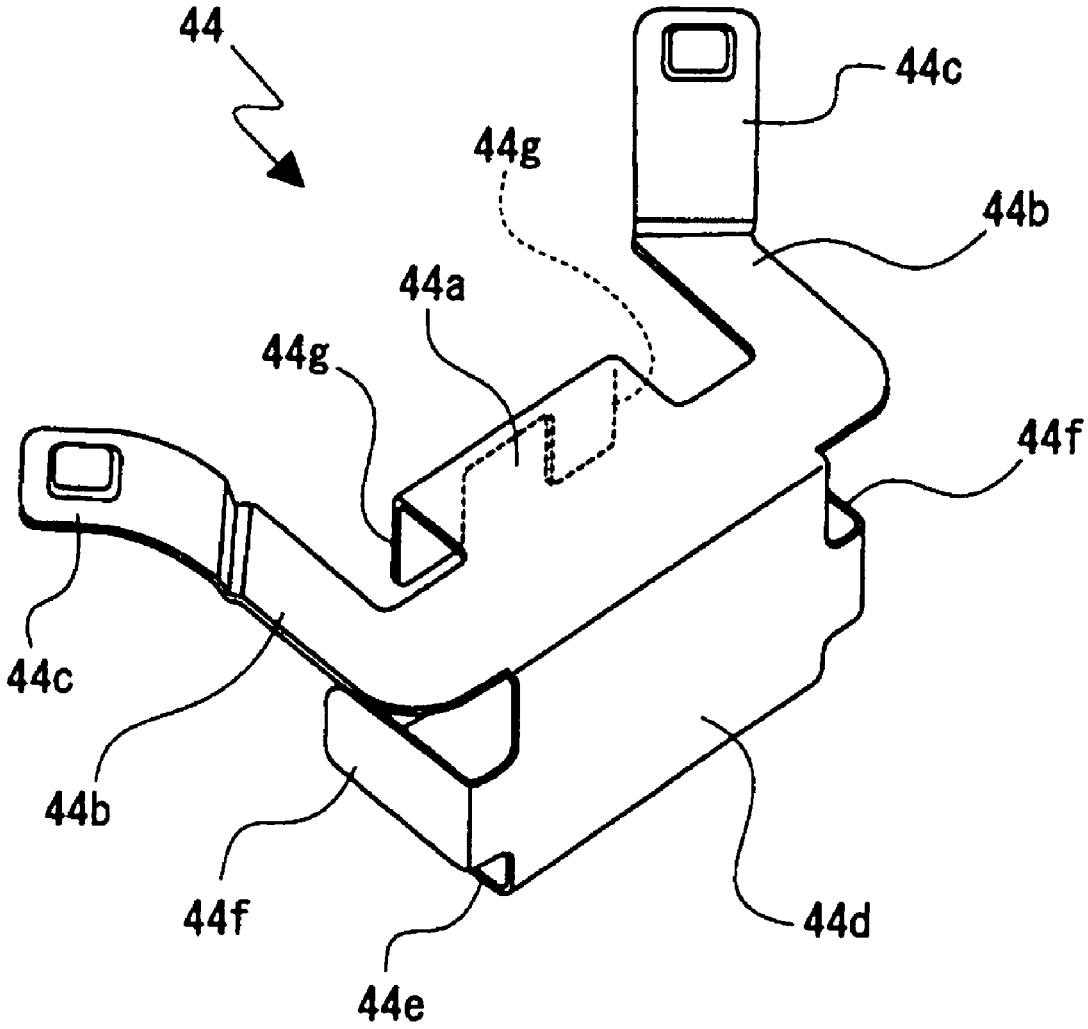
FIG. 11 is an enlarged perspective view of a conductive member according to a third modification of the present invention.
Figure 12:
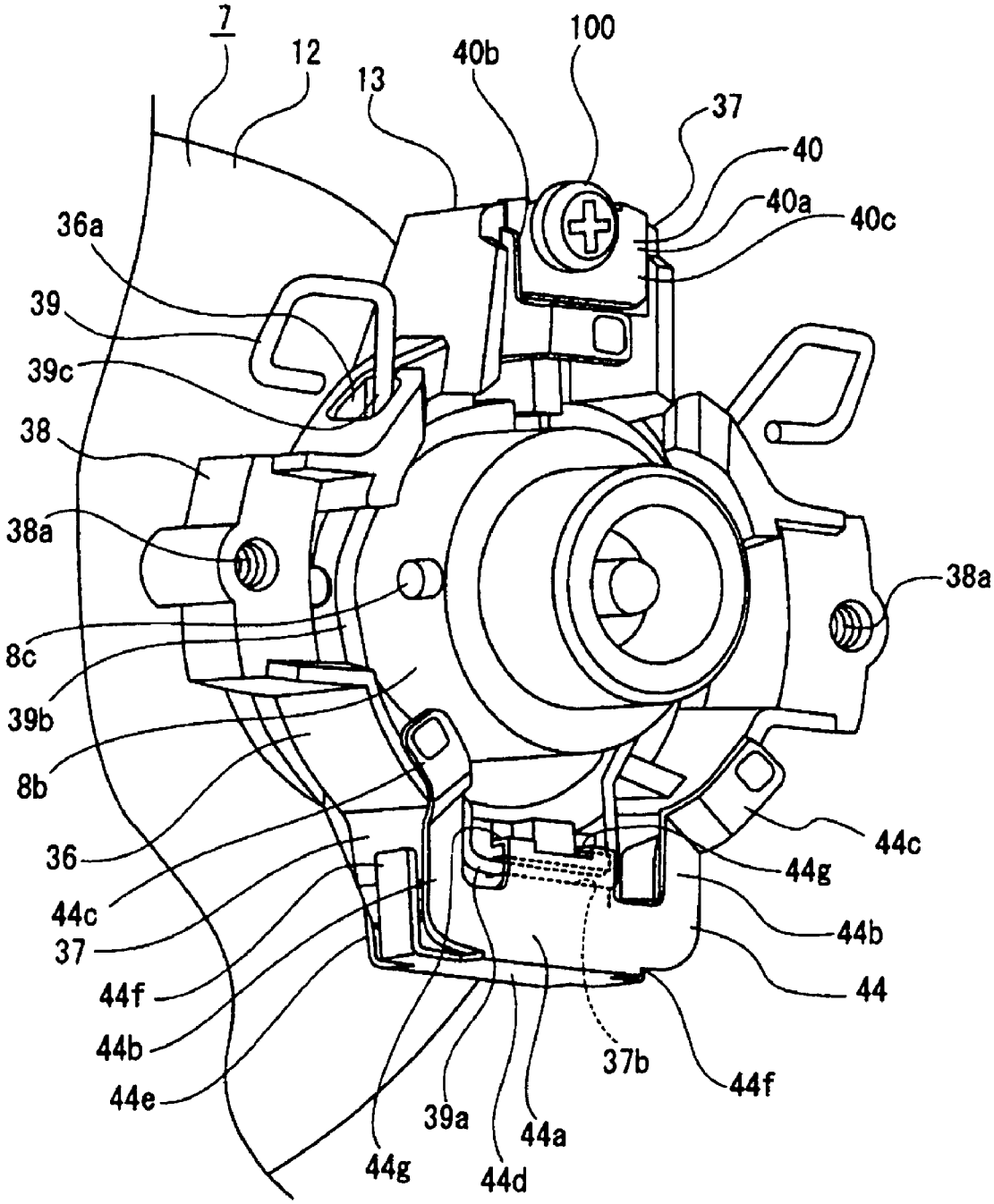
FIG. 12 is an enlarged perspective view showing the conductive member according to the third modification mounted on the lamp holding part of the reflector.

A conductive member 44 according to a third modification is mounted on the lower mounting protrusion 37 of the lamp holding part 13 of the reflector 7 (see FIGS. 11 and 12). Meanwhile, in FIG. 12, not only the conductive member 44, but also the conductive member 40 mounted on the mounting protrusion 37, is used as a leaf spring member that is to be connected to the conductive plate 34 of the socket 19.

The conductive member 44 includes a first mounted surface portion 44*a* that faces the front-and-rear direction, connection-surface portions 44*b* that respectively protrude upward from the left and right ends of the first mounted surface portion 44*a*, and connection pieces 44*c* that respectively continue to the connection-surface portions 44*b* and substantially face front-and-rear direction.

In addition, the conductive member 44 includes a second mounted surface portion 44*d* that protrudes forward from the lower edge of the first mounted surface portion 44*a*, a third mounted surface portion 44*e* that protrudes upward from the front edge of the second mounted surface portion 44*d*, fourth mounted surface portions 44*f* that respectively protrude upward from the left and right side edges of the second mounted surface portion 44*d*, and fifth mounted surface portions 44*g* that protrude forward from the upper edge of the first mounted surface portion 44*a*.

The connection piece 40*c* of the conductive member 40 and the connection pieces 44*c* of the conductive member 44 are connected to the conducting portion 34*a* of the conductive plate 34 of the socket 19.

The conductive member 44 is mounted on the mounting protrusion 38 so that the mounting protrusion 38 is interposed between the third and first mounted surface portions 44*e* and 44*a* in the front-and-rear direction, is interposed between the fifth mounted surface portions 44*g* and the second mounted surface portion 44*d* in the up-and-down direction, and is interposed between the fourth mounted surface portions 44*f* in the left-and-right direction.

Further, when the supported portion 39*a* of the fixing member 39 is supported by the supporting groove 37*b*, the first mounted surface portion 44*a* of the conductive member 44 is mounted on the mounting protrusion 38 while covering the supported portion 39*a* from the rear side.

Accordingly, when the conductive member 44 is used, the mounting screw 100 is not needed to mount the conductive member 44 on the mounting protrusion 38 and support the fixing member 39 by the mounting protrusion 38 and it may be possible to reduce the number of parts and easily perform the mounting of parts.

Further, since the conductive member 44 includes two connection pieces 44*c*, it may be possible to increase the contact area between the conductive member 44 and the conducting portion 34*a* of the conductive plate 34 without increasing the number of parts, like in the cases of the conductive members 41 and 43.

Figure 13:
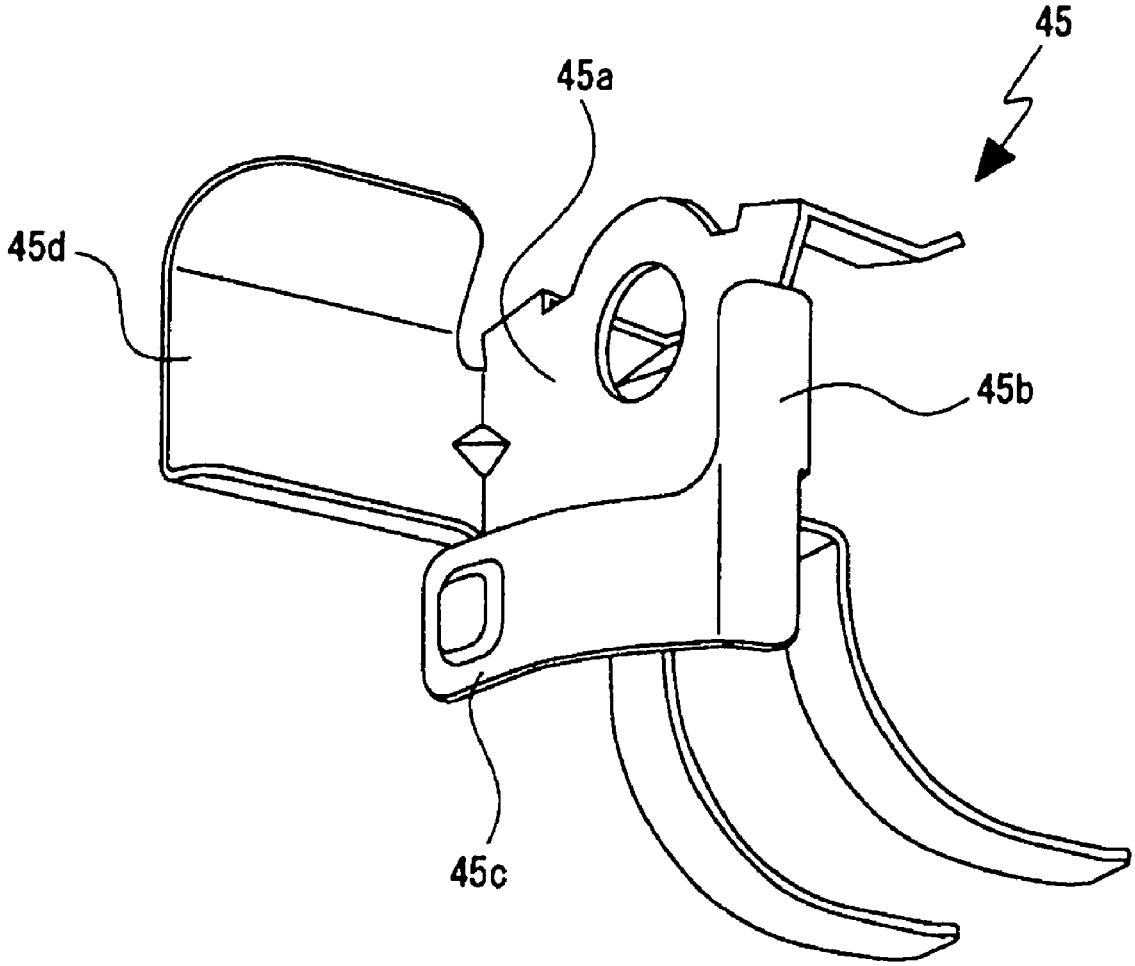
FIG. 13 is an enlarged perspective view of a conductive member according to a fourth modification of the present invention.
Figure 14:
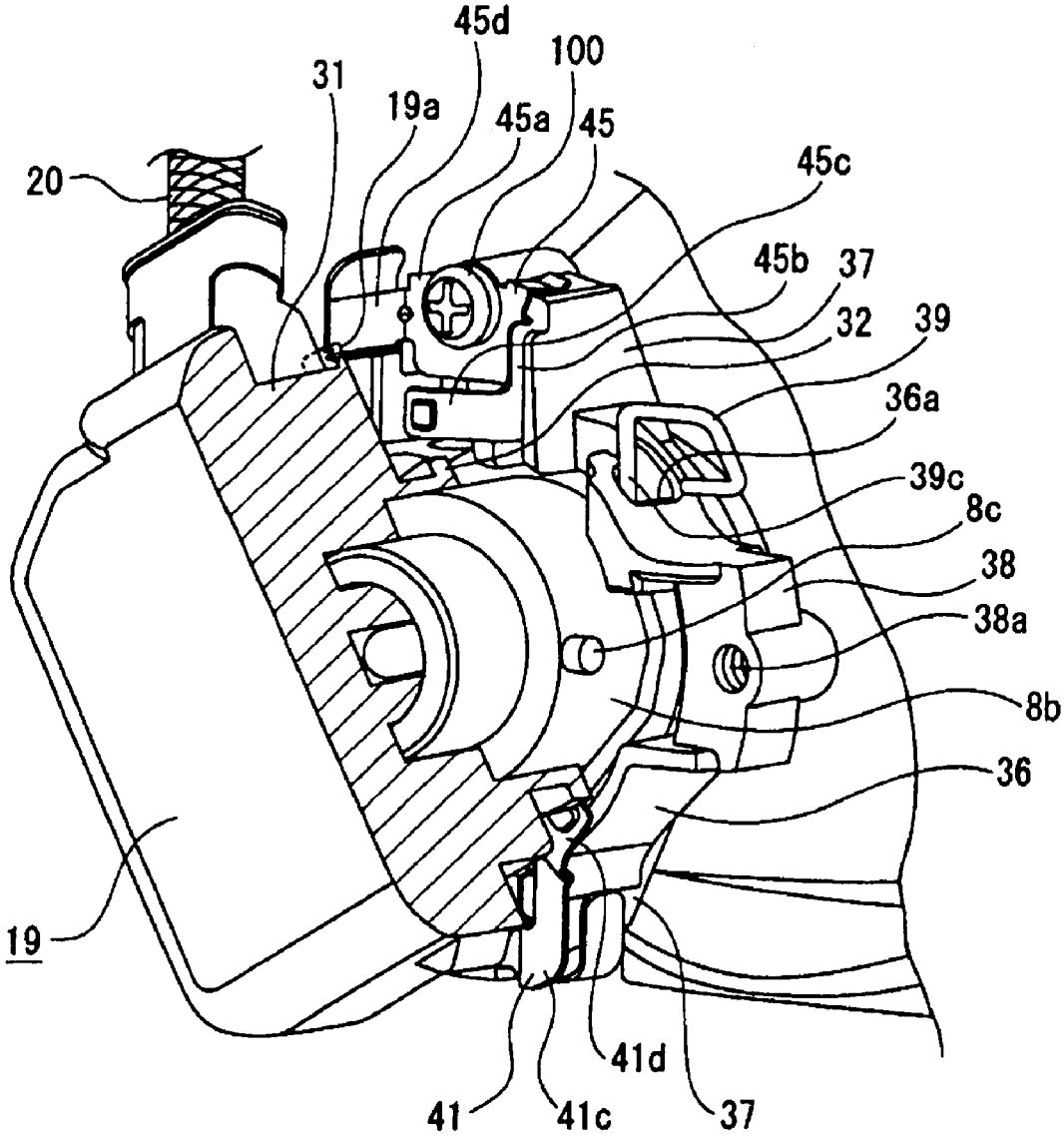
FIG. 14 is an enlarged perspective view showing the state that the mounting of the socket on the discharge lamp in a wrong direction is restricted by a connection restricting protrusion of the conductive member according to the fourth modification.

A conductive member 45 according to a fourth modification is mounted on the upper mounting protrusion 37 of the lamp holding part 13 of the reflector 7 (see FIGS. 13 and 14). Meanwhile, in FIG. 14, not only the conductive member 45 but also the conductive member 41 mounted on the mounting protrusion 37 is used as a leaf spring member that is to be connected to the conductive plate 34 of the socket 19.

The conductive member 45 includes a mounted surface portion 45*a* that faces the front-and-rear direction, a connection-surface portion 45*b* that protrudes rearward from one side edge of the mounted surface portion 45*a*, a connection piece 45*c* that is bent from the rear edge of the connection-surface portion 45*b* and substantially faces the front-and-rear direction, and a connection restricting protrusion 45*d* that protrudes rearward from the other side edge of the mounted surface portion 45*a*.

The connection piece 45*c* of the conductive member 45 and the connection pieces 41*d* of the conductive member 41 are connected to the conducting portion 34*a* of the conductive plate 34 of the socket 19.

The mounted surface portion 45*a* of the conductive member 45 is mounted on the mounting protrusion 37 by the mounting screw 100 that is tightened to the threaded hole 37*a*.

Since the conductive member 45 includes the connection restricting protrusion 45*d* as described above, the connection restricting protrusion 45*d* prevents the socket 19 from being improperly connected to the discharge lamp 8 in a reversed direction, that is, in an upside-down manner as described below.

A contact protrusion 19*a*, which protrudes downward, is formed at the lower end portion of the socket 19.

If the socket 19 approaches the cap 8*b* from the rear side in the opposite up-and-down direction by mistake when the socket 19 is connected to the discharge lamp 8, the contact protrusion 19*a* of the socket 19 comes into contact with the connection restricting protrusion 45*d* of the conductive member 45 from the rear side (see FIG. 14). Accordingly, the forward movement of the socket 19 is restricted by the connection restricting protrusion 45*d*, so that the mounting pins 8*c* of the discharge lamp 8 are not inserted into the insertion grooves 32*a* of the socket 19. As a result, it may not be possible to connect the connection portion 32 of the socket 19 to the cap 8*b* of the discharge lamp 8.

Meanwhile, the contact protrusion 19*a* has been formed at the socket 19 in the above-mentioned embodiment. However, if the shape of the socket 19 is formed so that a part of the socket 19 comes into contact with the connection restricting protrusion 45*d* when the socket approaches the cap 8*b* in the reversed or upside-down direction and any portion of the socket 19 does not come into contact with the connection restricting protrusion 45*d* when the socket approaches the cap 8*b* in a normal direction, the contact protrusion 19*a* may not be formed in particular.

As described above, when the conductive member 45 includes the connection restricting protrusion 45*d*, it may be possible to prevent the socket 19 from being connected to the discharge lamp 8 in a wrong direction.

Further, since the connection restricting protrusion 45*d* is formed integrally with the conductive member 45, it is not necessary to further form a dedicated portion that prevents the socket 19 from being connected to the discharge lamp 8 in a wrong direction. Accordingly, it may be possible to reduce the number of parts.

Figure 15:
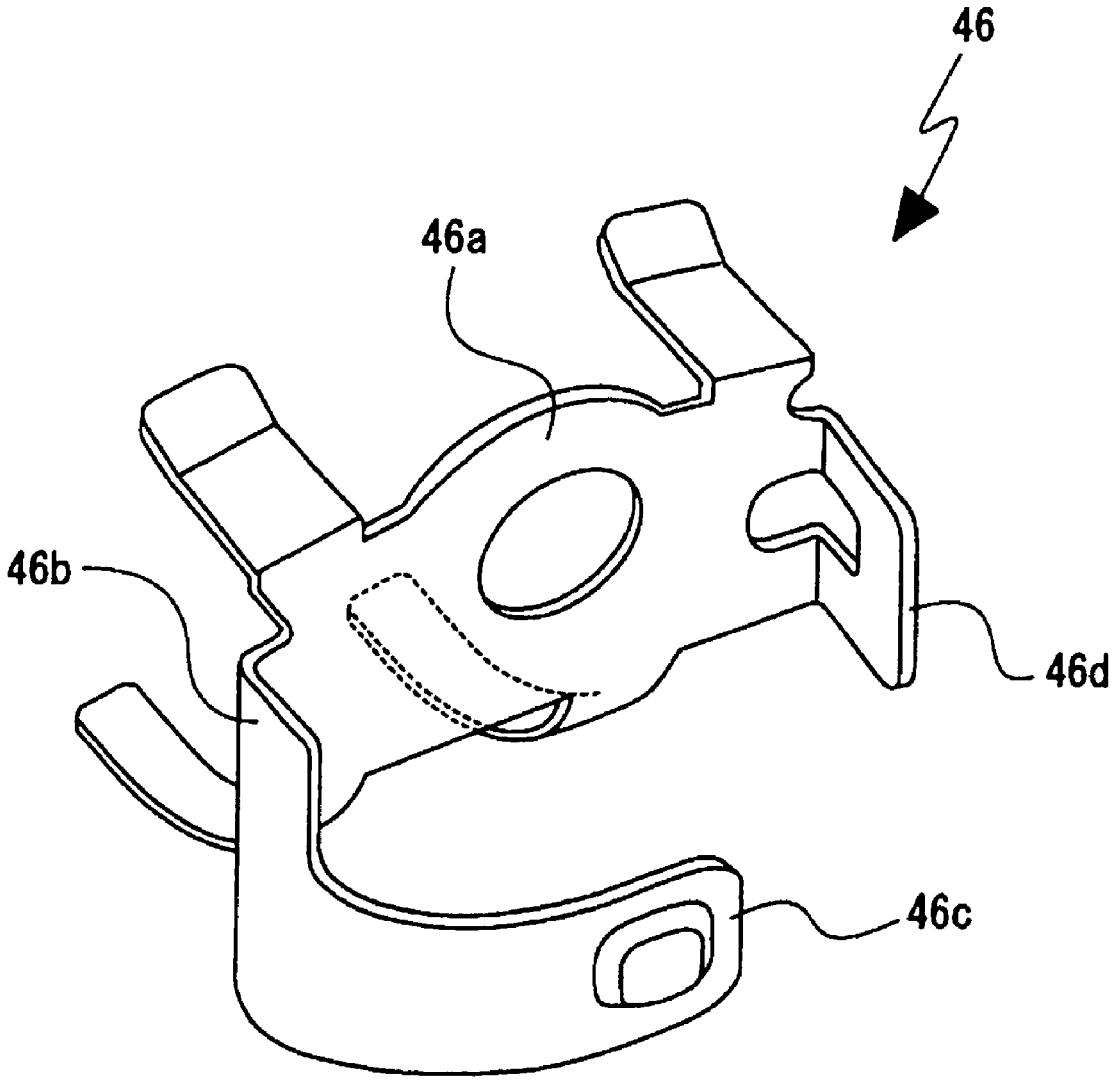
FIG. 15 is an enlarged perspective view of a conductive member according to a fifth modification of the present invention.
Figure 16:
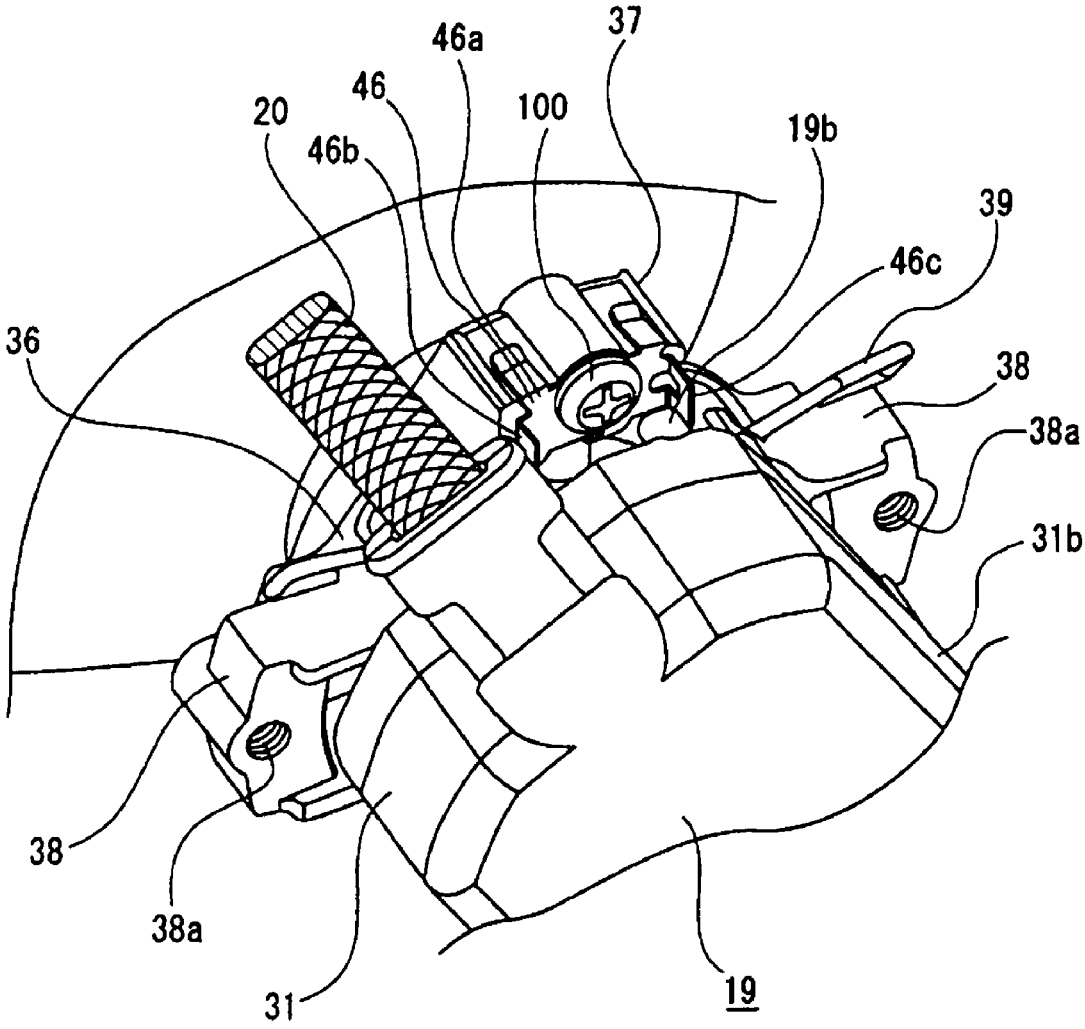
FIG. 16 is an enlarged perspective view showing the state that the mounting of the socket on the discharge lamp in a wrong direction is restricted by a connection restricting protrusion of the conductive member according to the fifth modification.

A conductive member 46 according to a fifth modification is mounted on the upper mounting protrusion 37 of the lamp holding part 13 of the reflector 7 (see FIGS. 15 and 16). Meanwhile, in FIG. 16, not only the conductive member 46 but also the conductive member 41 mounted on the mounting protrusion 37 is used as a leaf spring member that is to be connected to the conductive plate 34 of the socket 19.

The conductive member 46 includes a mounted surface portion 46*a* that faces the front-and-rear direction, a connection-surface portion 46*b* that protrudes rearward from one side edge of the mounted surface portion 46*a*, a connection piece 46*c* that is bent from the rear edge of the connection-surface portion 46*b* and substantially faces the front-and-rear direction, and a connection restricting protrusion 46*d* that protrudes rearward from the other side edge of the mounted surface portion 46*a*.

The connection piece 46*c* of the conductive member 46 and the connection pieces 41*d* of the conductive member 41 are connected to the conducting portion 34*a* of the conductive plate 34 of the socket 19.

The mounted surface portion 46*a* of the conductive member 46 is mounted on the mounting protrusion 37 by the mounting screw 100 that is tightened to the threaded hole 37*a*.

Since the conductive member 46 includes the connection restricting protrusion 46*d* as described above, the connection restricting protrusion 46*d* prevents the socket 19 from being improperly connected to the discharge lamp 8 in the wrong direction, that is, in a reversed or upside-down manner as described below.

A contact pin 19*b*, which protrudes forward, is formed at the lower end portion of the socket 19.

If the socket 19 approaches the cap 8*b* from the rear side in the reversed or upside-down direction by mistake when the socket 19 is connected to the discharge lamp 8, the mounting pins 8*c* of the discharge lamp 8 are inserted into the insertion grooves 32*a* of the socket 19, respectively.

After that, if the socket 19 is to be rotated with respect to the discharge lamp 8, the contact pin 19*b* of the socket 19 comes into contact with the connection restricting protrusion 46*d* of the conductive member 46 from the rear side (see FIG. 16). Accordingly, the rotation of the socket 19 with respect to the discharge lamp 8 is restricted by the connection restricting protrusion 46*d*, so that it may not be possible to connect the connection portion 32 of the socket 19 to the cap 8*b* of the discharge lamp 8.

As described above, when the conductive member 46 includes the connection restricting protrusion 46*d*, it may be possible to prevent the socket 19 from being connected to the discharge lamp 8 in a wrong direction. Accordingly, the cable 20 connected to the socket 19 does not interfere with components of the lamp unit 6 or the like, and it may be possible to prevent a bad influence on the swivel function of the vehicle headlamp 1.

Further, since the connection restricting protrusion 46*d* is formed integrally with the conductive member 46, it is not necessary to further form a dedicated portion such as a rib, which prevents the socket 19 from being connected to the discharge lamp 8 in a wrong direction, at the reflector 7 or the socket 19. Accordingly, it may be possible to reduce the number of parts.

As described above, in the vehicle headlamp 1, the conductive members 40, 41, 42, 43, 44, 45, and 46 are connected to the conducting portion 34*a* of the conductive plate 34 of the socket 19 in the front-and-rear direction, that is, in the direction the discharge lamp 8 is fitted to the socket 19, and the conductive members 40, 41, 42, 43, 44, 45, and 46 are not disposed at the periphery of the socket 19. Accordingly, the vehicle headlamp 1 does not increase in size toward the periphery of the socket 19, and may secure good conductivity between the reflector 7 and the socket 19 and reduce the size of the vehicle headlamp 1.

In particular, the socket 19, in which the high-voltage generator 24 including a starting circuit is provided, is apt to increase in size. However, even when the large socket 19 is used, the vehicle headlamp 1 does not needlessly increase in size.

Meanwhile, since the conductive member and the conducting portion are connected to each other in the direction the socket is mounted on the discharge lamp, the present invention may be applied to not only the vehicle headlamp 1 where the discharge lamp 8 is connected to the lamp holding part 13 from the rear side but also a vehicle headlamp where a discharge lamp is connected to a lamp holding part from the side.

While the present invention has been shown and described with reference to certain exemplary embodiments thereof, it will be understood by those skilled in the art that various changes in form and details may be made therein without departing from the spirit and scope of the invention as defined by the appended claims. Therefore, it covers in the appended claim all such changes and modifications as fall within the true spirit and scope of the present invention.

What is claimed is:

1. A vehicle headlamp comprising:

a discharge lamp, comprising:

a light source that emits light, and a cap that holds the light source;

a reflector comprising:

a light reflecting part that reflects the light emitted from the light source, and a lamp holding part, which is formed contiguously with one end of the light reflecting part and which holds the cap; and a socket, which is connected to the cap and which supplies drive current to the discharge lamp, the socket comprising:

a case, and a connection portion, which is connected to the cap, and which protrudes toward the cap from a surface of the case facing the cap, a conductive member mounted on the lamp holding part to transmit noise generated when the discharge lamp is turned on, and a conducting portion formed on the surface of the case facing the cap, the conducting portion surrounding the connection portion, and wherein the conductive member and the conducting portion are connected to each other in a same connection direction along which the cap is inserted into the connection portion.

2. The vehicle headlamp according to claim 1, wherein the case holds a starting circuit which turns on the discharge lamp.

3. The vehicle headlamp according to claim 1, wherein the conductive member is a leaf spring member, which includes a connection piece that is elastically deformable in the connection direction.

4. The vehicle headlamp according to claim 3, wherein when the connection portion of the socket is connected to the cap, the socket is moved with respect to the lamp holding part to approach the discharge lamp, and the conducting portion is pressed against the connection piece such that the connection piece is elastically deformed.

5. The vehicle headlamp according to claim 1, further comprising:

a fixing member comprising:

a supported portion that is supported by the lamp holding part of the reflector; and a pressing portion that presses the cap against the lamp holding part to fix the cap to the lamp holding part, and wherein the supported portion and a part of the conductive member are mounted on the lamp holding part by a single mounting screw.

6. The vehicle headlamp according to claim 1, wherein the conductive member comprises:

a connection restricting protrusion that prevents the connection portion from being connected to the cap in a wrong direction.

7. The vehicle headlamp according to claim 1, wherein the conductive member comprises:

a mounted surface portion, which is mounted on a rear of the lamp holding part;

a connection-surface portion, which protrudes rearward from a first side edge of the mounted surface portion; and a connection piece, which is bent from a rear edge of the connection-surface portion and is compressed in the connection direction.

8. The vehicle headlamp according to claim 7, wherein the conductive member further comprises:

a connection restricting protrusion, which protrudes rearward from a second side edge of the mounted surface portion, the second side edge disposed opposite to the first side edge;

wherein the socket further comprises a contact pin, which protrudes forward from an end portion of the socket; and wherein the connection restricting protrusion engages the contact pin to prevent connection of the socket to the cap, if the socket is positioned in a wrong direction.

* * * * *